US010941923B1

(12) United States Patent
Wu et al.

(10) Patent No.: US 10,941,923 B1
(45) Date of Patent: Mar. 9, 2021

(54) SCREW MOUNTED LAMP STRING

(71) Applicant: ZHANGZHOU GO WIN LIGHTING CO., LTD, Zhangzhou (CN)

(72) Inventors: Qingan Wu, Zhangzhou (CN); Xiongzhong Lin, Zhangzhou (CN)

(73) Assignee: ZHANGZHOU GO WIN LIGHTING CO., LTD, Zhangzhou (CN)

( * ) Notice: Subject to any disclaimer, the term of this patent is extended or adjusted under 35 U.S.C. 154(b) by 0 days.

(21) Appl. No.: 16/854,897

(22) Filed: Apr. 22, 2020

(30) Foreign Application Priority Data

Jan. 8, 2020 (CN) ..... 202020033681.2

(51) Int. Cl.
*F21V 19/00* (2006.01)
*F21S 4/26* (2016.01)
*F21Y 115/10* (2016.01)

(52) U.S. Cl.
CPC ..... *F21V 19/0055* (2013.01); *F21S 4/26* (2016.01); *F21Y 2115/10* (2016.08)

(58) Field of Classification Search
CPC ..... F21V 19/0055; F21S 4/26
See application file for complete search history.

(56) References Cited

U.S. PATENT DOCUMENTS 5,404,282 A * 4/1995 Klinke ..... H01L 25/13 362/249.06
2008/0037249 A1* 2/2008 Lai ..... F21S 4/10 362/249.01

* cited by examiner

*Primary Examiner* — Thomas M Sember

(57) ABSTRACT

Disclosed is a screw mounted lamp string, comprising a LED lamp string having a number of LED holders connected with each other by wires and corresponding LED bulbs; wherein the screw mounted lamp string comprises a screw head; the live wire contact of the screw head is connected with a corresponding fuse tube, which is connected with the LED lamp string by wires. The screw head of the screw mounted lamp string can directly connect with the screw string, thereby realizing power supply to the LED lamp string, without additional power supply lines, which is saving costs, improving the convenience of using the LED lamp string, and improving the soldering efficiency of the patch LED and the resistance to external force impact, thus enabling the lamp string of the disclosure to have a better application effect in outdoor scenes.

5 Claims, 3 Drawing Sheets

SCREW MOUNTED LAMP STRING

CROSS REFERENCE TO RELATED APPLICATIONS

This application claims all benefits accruing under 35 U.S.C. § 119 from China Patent Application No. 202020033681.2, filed on Jan. 8, 2020, in the State Intellectual Property Office of China, the disclosure of which is incorporated herein by reference in its entirety.

TECHNICAL FIELD

The disclosure generally relates to the field of lighting and decorative equipment, and more particularly to a screw mounted lamp string.

BACKGROUND

LED lighting is light emitting diode lighting, which is a semiconductor solid-state light emitting device. It uses solid-state semiconductor chips as luminescent material and in semiconductors, excess energy is emitted through carrier recombination, which results in photon emission.

At present, the LED lamp strings on the market are generally provided with conventional two-pin copper knife plugs, but the sockets corresponding to the two-pin copper knife plugs are usually set indoors, while the lighting lines in outdoor venues mostly use screw-type strings as the power supply line. The screw sockets of the screw-type strings cannot directly connect with the two-pin copper knife plugs of the conventional LED lamp strings. Therefore, it is inconvenient to arrange additional power supply lines with two-pin sockets when conventional LED lamp strings are used in open outdoor areas.

Meanwhile, LED lamp strings are usually provided with LED bulbs. One of the brackets of the bulb encapsulation structure is usually provided with bowl-shaped grooves for placing the patch LED. The connecting points of the patch LED are connected with two electrodes and the corresponding wires respectively. When this encapsulation structure is soldered, it has small soldering area and the tensile strength of the solder joints and wires is low (about 5 g). During the soldering process, soldering due to factors, such as the pressure of machine platform, error in height of the LED bracket, the heat after spotting fluorescent powder and the stress during the encapsulation of LED, it is easy to cause partial fake soldering. During use of LED bulbs, undesirable conditions may occur due to expansion and contraction or external force impact. The bowl brackets also limits the illumination angle of the patch LED to less than 120 degrees, which results in unsatisfactory illumination.

The purpose of this disclosure is to design a screw mounted lamp string for the above existing technical problems.

SUMMARY OF DISCLOSURE

In view of the problems existing in the prior art, the disclosure provides a screw mounted lamp string which can directly connect with a screw holder for power supply, and can effectively solve the problems existing in the prior art.

The technical scheme of the disclosure is:

A screw mounted lamp string, comprising a LED lamp string having a number of LED holders connected with each other by wires and corresponding LED bulbs; wherein the screw mounted lamp string comprises a screw head; the live wire contact of the screw head is connected with a corresponding fuse tube, which is connected with the LED lamp string by wires.

Further, the LED bulbs comprises a positive electrode bracket, a negative electrode bracket, a patch LED and a encapsulation gel; the positive and negative ends of the patch LED are respectively fixed on the positive electrode bracket and the negative electrode bracket, and the connection ends of the positive electrode bracket and the negative electrode bracket to the patch LED are planar.

Further, the LED lamp holders are connected with each other in series or in parallel.

Further, a bridge rectifier encapsulation member composed of four rectifier diodes is further provided between the screw head and the LED lamp string.

Further, each LED lamp holders is provided with a corresponding current-limiting resistor inside.

Further, the surface of the patch LED has a phosphor layer.

The technical scheme has the following technical effects:

1. The screw head can directly connect with the screw string, thus realizing power supply to the LED lamp string without additional power lines, saving costs and improving the convenience of the lamp string in outdoor scenes;

2. The LED bulb of the disclose does not use the traditional wiring connection method and instead the two ends of the patch LED is directly connected with the corresponding brackets, the soldering wire process of direct insertion encapsulation of LED is reduced so as to reduce the unstable factors during soldering of the existing direct insertion encapsulation patch LED, which not only improves the soldering efficiency and the resistance to external force impact to the bulb, but also avoids the possibility of fake soldering. At the same time, the bracket without the design of bowl-type groove makes the luminous angle of the patch LED reach 180 degrees, which further improves the application of the lamp string of the disclose in outdoor scenes.

Figure 1:
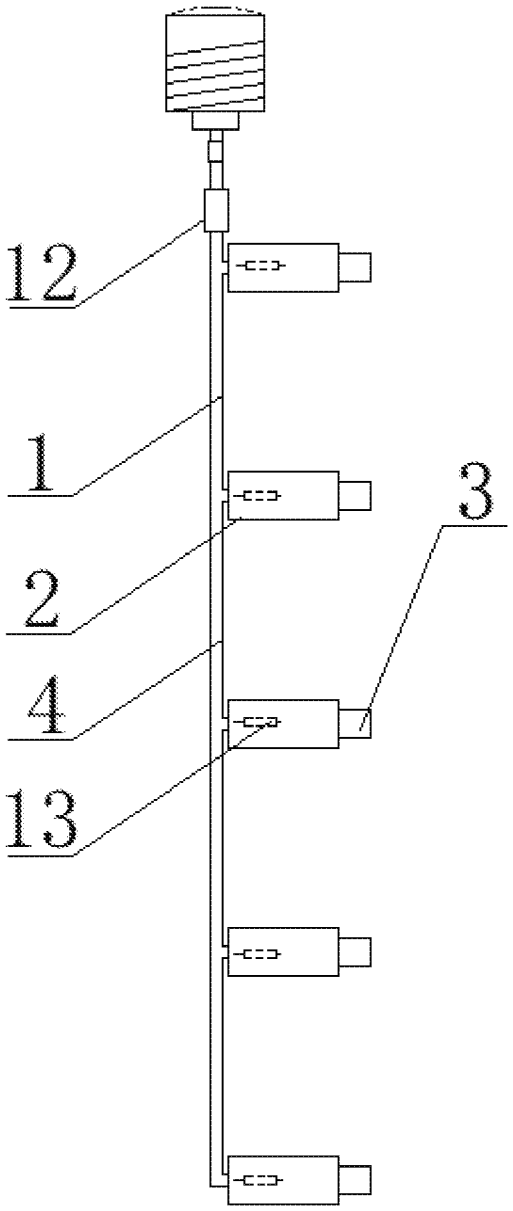
FIG. 1 is a structural diagram of the disclosure.

Attached Items: LED lamp string 1; LED holder 2; LED bulb 3; wire 4; screw head 5; fuse tube 6; positive electrode bracket 7; negative electrode bracket 8; patch LED 9; encapsulation gel 10; rectifier diode 11; bridge rectifier encapsulation member 12; current-limiting resistor 13.

DETAILED DESCRIPTION

Figure 3:
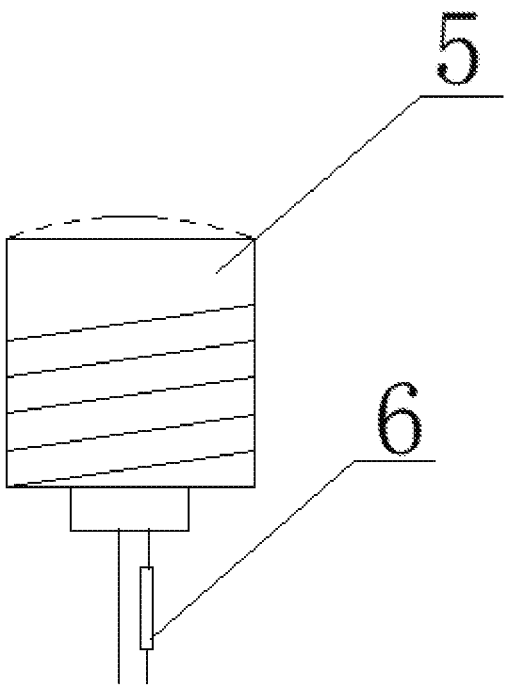
FIG. 3 is a structural diagram of a fuse tube.

To facilitate the understanding of those skilled in the art, the structure of the disclosure is further described in detail in connection with the accompanying drawings:

One embodiment of the disclosure, referring to FIGS. 1 and 3, is a screw mounted lamp string, comprising at least one LED lamp strings 1 having a number of LED holders 2 connected with each other by wires 4 and corresponding LED bulbs 3. The screw mounted lamp string comprises a screw head 5. The live wire contact of the screw head 5 is connected with a corresponding fuse tube 6, which is connected with the LED lamp string 1 by wires 4. In this embodiment, the LED lamp string 1 can be directly connected to the screw socket of the screw string through the screw head 5, so that the LED bulbs 3 can be powered without any additional power supply wires. Among these, the fuse tube 6 is mainly used to protect the LED lamp string 1 from potential safety hazards caused by instantaneous high current when short circuiting occurs.

Figure 2:
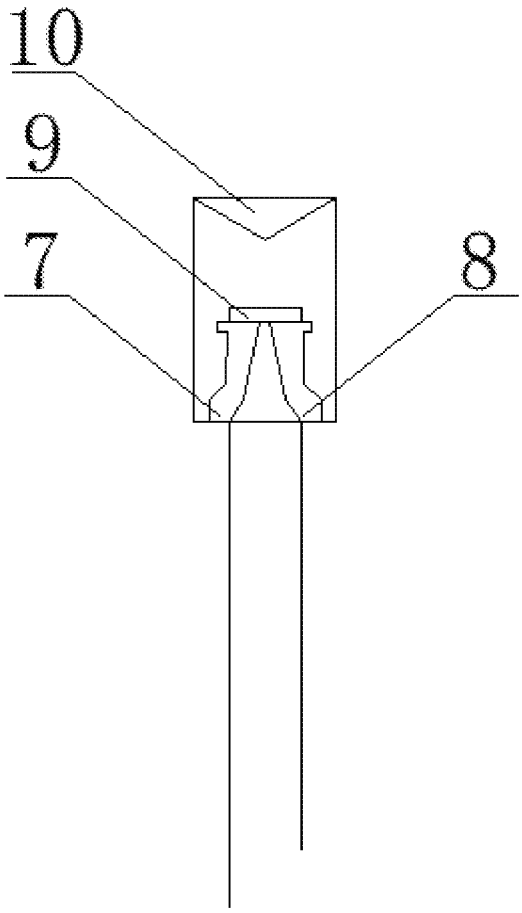
FIG. 2 is a structural diagram of an LED bulb.

Specifically, referring to FIG. 2, the LED bulbs 3 comprise a positive electrode bracket 7, a negative electrode bracket 8, a patch LED 9, and an encapsulation gel 10. The positive and negative ends of the patch LED 9 are respectively fixed to the positive electrode bracket 7 and the negative electrode bracket 8, and the connection ends of the positive electrode bracket 7 and the negative electrode bracket 8 to the patch LED 9 are planar. In this embodiment, instead of traditional wiring connection, the connection points at the positive and negative ends of the patch LED 9 are directly connected to the corresponding positive electrode bracket 7 and negative electrode bracket 8. On the one hand, the problem of external force impact is well solved, the patch LED 9 is fixed on the connection end of the bracket, the connection end is a planar with large soldering area compared with bowl groove, and it is easier to solder and stronger. On the other hand, the planar connection of the positive electrode bracket 7 and the negative electrode bracket 8 can also increase the luminous angle of the patch LED 9 to 180 degrees, which can solve the problem of small luminous angle of the conventional bowl bracket.

Specifically, the LED lamp holders 2 are connected with each other in series or in parallel.

Figure 4:
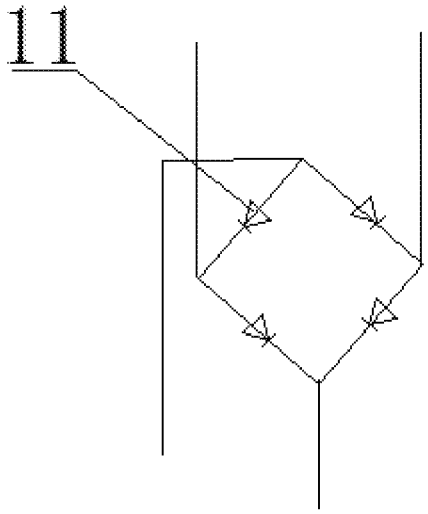
FIG. 4 is a structural diagram of a bridge rectifier encapsulation member.

Specifically, referring to FIG. 4, a bridge rectifier encapsulation member 12, consisting of four rectifier diodes 11, is also provided between the screw head 5 and the LED lamp string 1. In this embodiment, the bridge rectifier encapsulation member 12 uses wire 4 to connect with screw head 5 and LED lamp string 1. The screw head 5 obtains AC power through screw holder 2. The AC power passes through the fuse tube 6 and then is rectified by the bridge rectifier encapsulation member 12 to supply DC power to the LED lamp string 1.

Specifically, the LED lamp holder 2 is provided with a corresponding current-limiting resistor 13 inside. In this embodiment, a current-limiting resistor 13 is added to the LED holder 2 to control the current through the LED bulbs 3 not to exceed the rated operating current, thus ensuring service life of the LED lamp string 1.

Specifically, the surface of the patch LED 9 has a phosphor layer.

Embodiment 1

A screw mounted lamp string includes a LED lamp string 1, the LED lamp string 1 includes five LED holders 2 and corresponding LED bulbs 3, the LED holders 2 has corresponding current-limiting resistor 13 inside, the LED holders 2 are connected in series with each other by wires 4, and the screw mounted lamp string also includes a screw head 5, the live wire connection of the screw head 5 is connected with a corresponding fuse tube 6, and the fuse tube 6 is connected with the LED lamp string 1 by wire 4. A bridge rectifier encapsulation member 12, consisting of four rectifier diodes 11, is also provided between the screw head 5 and the LED lamp string 1.

Each of the LED bulb 3 consists of a positive electrode bracket 7, a negative electrode bracket 8, a patch LED 9 and an encapsulation gel 10. The positive and negative ends of the patch LED 9 are respectively fixed on the positive electrode bracket 7 and the negative electrode bracket 8, and the connection ends of the positive electrode bracket 7 and the negative electrode bracket 8 to the patch LED 9 are planar. The surface of the patch LED 9 has a phosphor layer.

Embodiment 2

A screw mounted lamp string includes more than one LED lamp strings 1 and one screw head 5, wherein all the LED lamp strings are connected to the screw head 5. The other structures are the same as the embodiment 1.

The foregoing description is only a preferred embodiment of the disclosure, and all changes and modifications to the patent scope applied for in accordance with the disclosure shall belong to the scope covered by the disclosure.

What is claimed is:

1. A screw mounted lamp string, comprising a LED lamp string having a number of LED holders connected with each other by wires and corresponding LED bulbs; wherein the screw mounted lamp string comprises a screw head; a live wire contact of the screw head is connected with a corresponding fuse tube, which is connected with the LED lamp string by wires; the LED bulbs comprises a positive electrode bracket, a negative electrode bracket, a patch LED and a encapsulation gel; a positive end and a negative end of the patch LED are respectively fixed on the positive electrode bracket and the negative electrode bracket, the positive electrode bracket comprises a first planar surface, the negative electrode bracket comprises a second planar surface, the first planar surface and the second planar surface are coplanar, two ends of the patch LED are respectively mounted on the first planar surface and the second planar surface.

2. The screw mounted lamp string according to claim 1, wherein the LED lamp holders are connected with each other in series or in parallel.

3. The screw mounted lamp string according to claim 1, wherein a bridge rectifier encapsulation member composed of four rectifier diodes is further provided between the screw head and the LED lamp string.

4. The screw mounted lamp string according to claim 1, wherein each LED lamp holders is provided with a corresponding current-limiting resistor inside.

5. The screw mounted lamp string according to claim 1, wherein a surface of the patch LED has a phosphor layer.

* * * * *